US005472162A

United States Patent [19]

Mason

[11] Patent Number: 5,472,162

[45] Date of Patent: Dec. 5, 1995

[54] CAP LOCK FOR SIGN STAND

[75] Inventor: James J. Mason, Northville, Mich.

[73] Assignee: Marketing Displays, Inc., Farmington Hills, Mich.

[21] Appl. No.: 160,896

[22] Filed: Dec. 1, 1993

[51] Int. Cl.[6] ..... G09F 15/00

[52] U.S. Cl. ..... 248/121; 40/606; 40/607; 40/611; 248/219.2; 248/222.11

[58] Field of Search ..... 248/121, 176, 248/218.4, 219.2, 221.3, 222.1; 40/606, 607, 610, 611

[56] References Cited

U.S. PATENT DOCUMENTS

| | | | |
|---|---|---|---|
| 2,202,237 | 5/1940 | Sullivan | 40/607 |
| 3,171,626 | 3/1965 | Keats | 40/607 X |
| 4,507,887 | 4/1985 | Seely | 40/606 |
| 4,888,894 | 12/1989 | Brown, Jr. | 40/607 X |
| 5,152,091 | 10/1992 | Leach | 40/606 X |
| 5,231,778 | 8/1993 | Belobraydich | 40/607 X |

*Primary Examiner*—Ramon O. Ramirez
*Assistant Examiner*—Derek J. Berger
*Attorney, Agent, or Firm*—Brooks & Kushman

[57] ABSTRACT

A locking mechanism for covering the open end of a sign stand upright extrusion and for releasably locking a roll-up sign in place in the upright. A cap member covers the end of the extrusion. The cap member has a slanted surface for ease of entry of the sign into the upright extrusion, and a locking pin member for releasably locking said sign in place. The locking pin is adapted to be manually manipulated and has a pointed leading end for mating with an opening or recess in the sign cross brace member. A stop is also provided in the upright extrusion for holding the sign at the required height.

12 Claims, 2 Drawing Sheets

CAP LOCK FOR SIGN STAND

TECHNICAL BACKGROUND

The present invention relates to a mechanism for a sign stand which holds and releasably locks a sign in place thereon.

BACKGROUND OF THE INVENTION

There are numerous sign stands known today which are used to hold and display traffic control and other signs, particularly roll-up signs, for view by passing motorists and pedestrians. Typically these sign stands have a plurality of legs or a base of some type, and an upright which is attached to the base and adapted to hold and display a sign. The upright can be secured to the base with a flexible or resilient mechanism, such as a pair of coil springs, in order to allow the sign and upright to deflect in the wind.

The signs used for these sign stands can be metal or wood signs, typically 36×36 inches or 48×48 inches, but preferably roll-up sign stands made of vinyl or other similar material are used. The roll-up signs are lighter and easier to store and use. With the roll-up signs, a pair of rotatable cross braces are used to hold the flexible sign material in place.

Various mechanisms have been used to attach and hold the signs to the vertical uprights of the sign stands: separate brackets can be provided for holding the horizontal cross brace member; an open channel in the upright can be provided for holding the lower portion of the vertical cross brace of the sign; or a separate bracket could be used which releasably holds the lower portion of the vertical cross brace member.

When a hollow extrusion has been used for the upright, it is sometimes difficult to position the lowermost part of the vertical cross brace member in the channel. Also, it is sometimes difficult to position a retaining pin through openings in the channel and the vertical cross brace member in order to hold it in place. It has also sometimes been difficult to assure that the sign is maintained at the minimum height from the ground as required by federal regulations.

It is an object of the present invention to provide an improved mechanism for securing a roll-up sign to a sign stand. It is also an object of the present invention to provide a unique cap lock mechanism which can be positioned on the upper end of a sign stand upright extrusion and retain a roll-up sign in place. It is another object of the invention to provide a locking mechanism for a sign on a sign stand which automatically locks the sign in place and does not require a separate step of inserting a locking pin in place.

These and other objects, features and benefits of the invention will become apparent from the following description of the invention and drawings, particularly when viewed in accordance with the appended claims.

SUMMARY OF THE INVENTION

The present invention discloses a unique cap and locking mechanism for a sign stand upright. The mechanism provides a cap structure for the open end of the sign stand upright extrusion and at the same time provides a releasable locking mechanism for a roll-up sign which firmly positions and holds the sign in place for viewing.

The cap mechanism is securely attached to the top of the extrusion by rivets or the like. The mechanism, which is typically formed from a molded plastic material, has a spring-loaded locking pin for mating with a hole in the lower portion of the vertical cross brace member on the sign stand. The cap mechanism has a channel for insertion of the vertical cross brace into the upright so that the spring-biased locking pin can be directed into the hole. The end of the locking pin is ramped and angled to facilitate automatic locking. A positive stop is also provided on the upright in order to fixedly position the sign stand relative to the ground.

If desired, a strap can be provided on the lower end of the vertical upright of the sign in order to wrap around the sign stand upright and assist in holding the sign in place.

DESCRIPTION OF THE PREFERRED EMBODIMENT(S)

Figure 1:
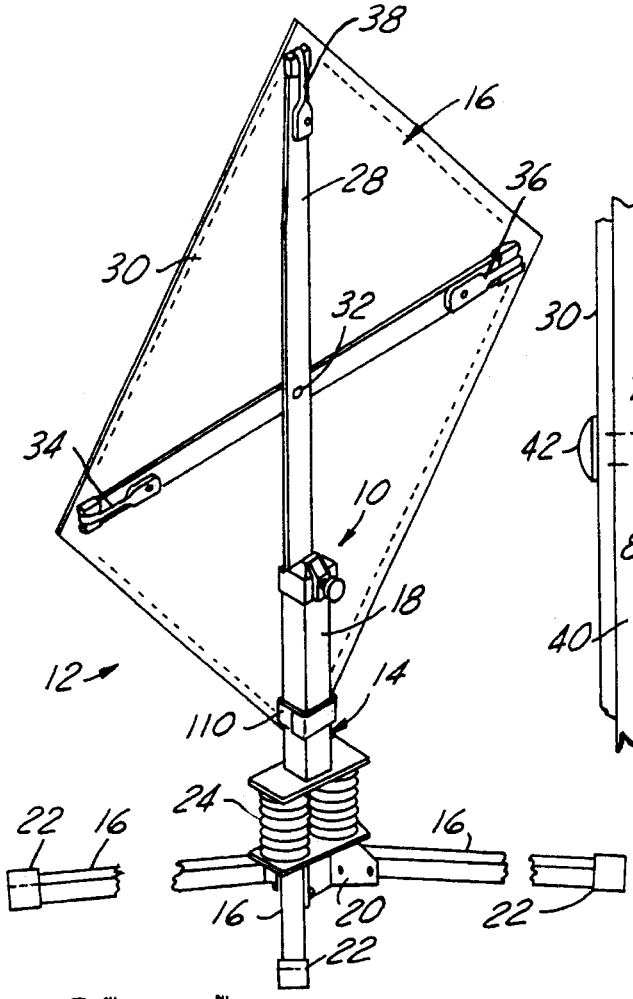
FIG. 1 illustrates a sign and sign stand in accordance with the present invention.

FIGS. 1–6 illustrate the use and details of the present invention. The present invention comprises a cap and locking mechanism 10 which is used on a sign and sign stand apparatus generally referred to by the numeral 12 in the drawings.

The sign and sign stand mechanism comprises a base member 14 and a sign member 16. The base member 14 includes a plurality of ground engaging leg members 15 and an upright member 18 which is used to hold the sign 16 in place. The legs 15 can be pivotally attached to the base by base structure member 20 and can have protective end cap 22 on the outer ends thereof. Typically, four leg members 15 are provided.

The upright 14 is typically attached to the base by a resilient mechanism, such as a pair of coil spring 24. The coil springs allow the upright member 14 to bend and deflect relative to the leg members when the sign is exposed to strong wind conditions. Such a mechanism is described, for example, in U.S. Pat. Nos. 3,646,696 and 3,662,482.

Figure 4:
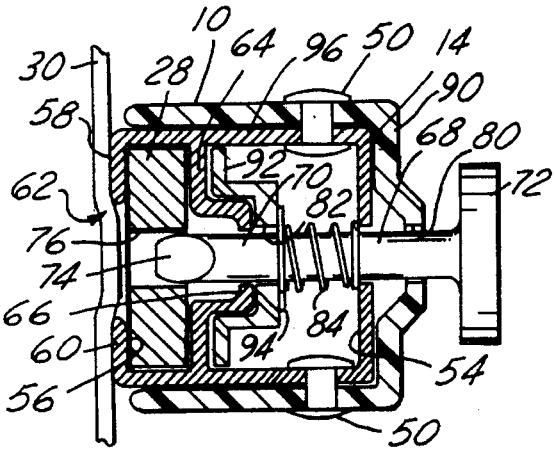
FIG. 4 is a cross-sectional view taken along lines 4—4 of FIG. 3 and in the direction of the arrows.
Figure 2:
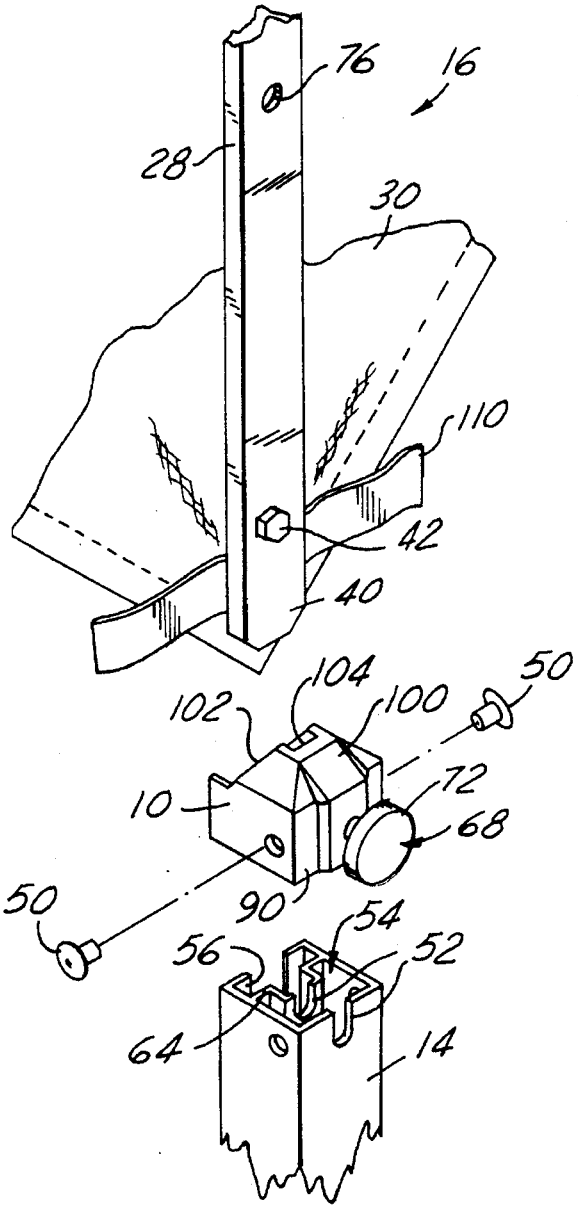
FIG. 2 is an exploded view showing the sign, cap mechanism, and sign stand upright.

The upright member 14 is typically made from an extruded metal material, such as aluminum, and preferably has the cross-sectional size and shape shown in the drawings (see FIGS. 2 and 4 in particular). Other sign stands having upright members are shown for example in U.S. Pat. Nos. 4,507,887, 4,548,379 and 4,593,879, which are also assigned to the same assignee as the present application, and the disclosures of which are incorporated herein by reference.

The sign member 16 includes a pair of cross brace members 26 and 28 and a flexible sign panel 30 mounted thereon. The sign 16 is typically 36 inches by 36 inches or 48 inches by 48 inches in size which are standard dimensions in the industry. The sign panel 30 typically has a message or warning notice on the side opposite that shown in FIG. 1 so that when the sign and sign stand are positioned along a highway or construction zone, vehicular and pedestrian traffic are adequately warned or given appropriate notice.

Figure 5:
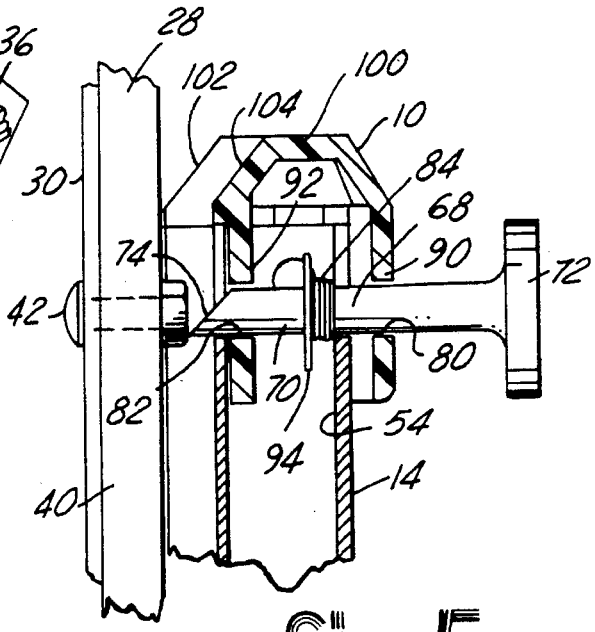
FIG. 5 is a cross-sectional side view showing the sign being partially inserted in the upright.

The cross braces 26 and 28 are pivoted together in their center by a pivot pin 32 so that the sign 16 can be folded and rolled up for storage when not in use. The two horizontally oriented corners 34 and 36 of the sign 16, together with the upper vertically oriented corner 38, are typically releasably attached to their respective cross brace members. In this regard, there are a number of known ways for attaching signs to cross braces known in the art today, such as turn locks, plastic pockets, Velcro straps and stretchable elastomeric straps (the latter way being shown in FIG. 1). The lower corner 40 of the sign 16 is preferably permanently attached to the lower end of the vertical cross brace member 28, such as by a bolt, washer and nut assembly 42, as shown in FIGS. 2 and 5.

The cap mechanism 10 is positioned on the upper end of the vertical upright 14. The cap 10 is preferably made from a molded plastic material, such as DuPont Zytel resin, which is glass filled nylon, or an equivalent material. The material also preferably is ultraviolet resistant for durability and longevity.

The cap member preferably has the size and shape shown in the drawings. The member 10 is securely attached to the top of the extrusion member 14 by a pair of pop rivets 50 or the like. Also, a pair of U-shaped notches 52 are formed in the vertical walls of the upright member 14 in order to provide clearance for the locking pin 68 of the cap mechanism (as described below).

The upright extrusion 14 also preferably has the size and cross sectional shape as shown in the drawings. In this regard, the extrusion 14 has an enclosed channel structure 54 and an open channel 56 on one side. The open channel 56 is formed by a pair of flange members 58 and 60. The flange members 58 and 60 leave an open area 62 on one side of the upright member 14. The central rib 64 of the upright 14 has an elongated channel 66 formed in it which provides a clearance for the bolt and washer mechanism 42 of the sign 16.

The cap member 10 has a spring mounted locking pin member 68 mounted in it. The pin has an elongated shaft 70 and a head 72 which is enlarged so that it can be manually grasped and operated by a construction worker or the like. The shaft 70 of pin 68 also has a slanted or angled front end 74 which facilitates insertion of the vertical cross brace into the upright 14, as well as insertion of the pin member into the hole or aperture 76 in the vertical upright cross brace member 28. It is understood that the mating locking structure 76 in the cross brace can be an opening, a recess or pocket, or any other type of locking structure which secures and holds in place the end of the locking pin 68.

The locking pin 68 is positioned in apertures 80 and 82 in the cap member 10. A biasing spring 84 is positioned over the shaft 70 of the pin 68 and placed between walls 90 and 92 of the cap member 10. A cotter pin or retaining clip 94 is used to hold the pin 68 in place in the cap member 10 and also used to compress the spring 84 when the pin is manipulated in order to provide the biasing feature.

The cap member 10 further has side walls 96 and 98 which fit over the upright extrusion 14, and an upper cover member 100 which is used to enclose the cap member and also cover the open channel 54 of the upright. The cover member prevents water and debris from entering the open end of the upright extrusion 14.

Surface 102 of the cover member 100 of the cap member 10 is slanted toward the open channel 56 of the upright 14. This allows easier entry of the lower portion of the vertical cross brace member into the upright 14. Channel 104 is also formed or provided in the slanted surface portion 102 of the cap member to provide clearance for the bolt 42 when the sign is mounted onto the stand.

Not only does the cap member provide a mechanism for releasable locking the sign in place in the sign stand, it also provides a structure which covers the relatively sharp edges of the upright 14 and provides a more pleasing and aesthetic appearance.

The operation of the sign stand with the cap 10 is shown in the drawings. The sign 16 in its display position as shown in FIG. 1 is attached to the base 18 by inserting the lower portion 41 of the vertical cross brace member 28 into the channel 56 in the upright 14. The slanted surface 102 on the cap member 100 is used to guide the lower portion 41 into the channel 56. The slanted face is particularly useful when the sign is being assembled in windy conditions.

Figure 6:
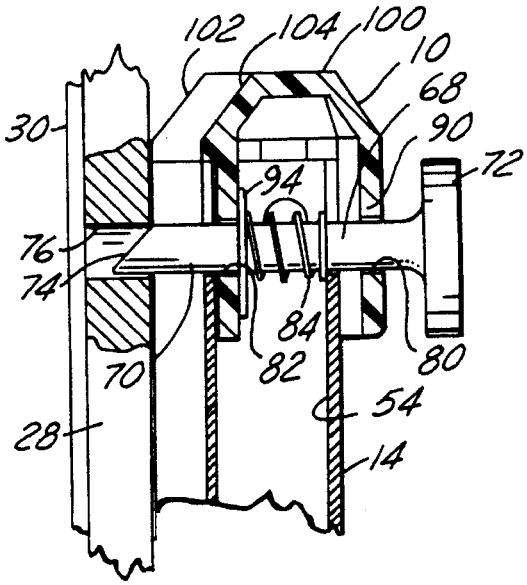
FIG. 6 is a cross-sectional view of the sign stand of FIG. 3 taken along lines 6—6 thereof and in the direction of the arrows.
Figure 3:
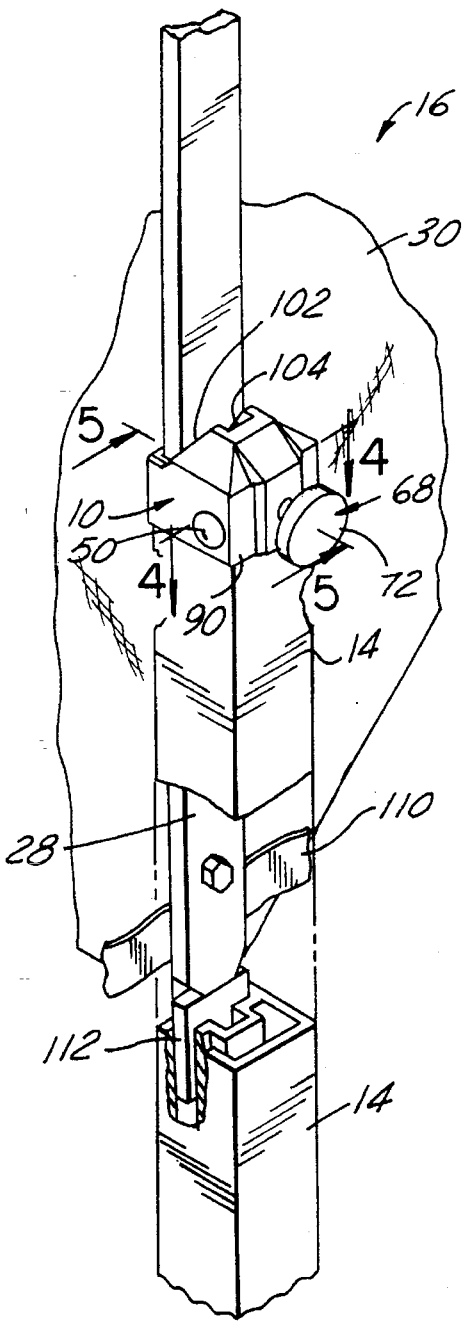
FIG. 3 illustrates the preferred use of the present invention.

Once the lower end 41 of the sign is in the channel 56, the sign 16 is forced downwardly so that the bolt and nut mechanism 42 passes by the locking pin 68 (as shown in FIG. 5) and finally until the pin 68 snaps into place in the hole 76 in the vertical upright cross brace member 28 (as shown in FIG. 6). The final position is shown in FIGS. 3, 4 and 6. At this point, the sign 16 is firmly locked in the vertical upright 14 and cannot be removed unless the pin member 68 is manually disengaged from the hole 76.

When it is desired to disassemble the sign and sign stand and remove the sign from the sign stand, the head 72 of the locking pin 68 is manually grasped and pulled outwardly until the slanted front end 74 clears the cross brace member 28 and the sign can be removed vertically upwardly. The cap and lock member mechanism 10 thus provides a positive lock for the sign in the sign stand and a manual release actuation is needed in order to remove it.

In order to further secure the sign 16 to the sign stand 18, it is also possible to include an auxiliary strap member 110 on the lower corner 40 of the sign 16. The strap member 110 is preferably made of a Velcro material and is attached to the lower portion 40 of the sign panel 30. After the sign 16 is inserted in the upright 14 and locked in place by the cap and lock mechanism 10, the Velcro strap 110 is wrapped around and secured to the upright 14. This is shown in FIGS. 1 and 3. The strap member 110 provides additional support and protection for the sign panel 30 from being detached from the vertical upright 28 in high wind conditions.

Stop member 112 is provided in the channel 56 of the upright 14 in order to prevent the vertical upright 28 of sign 16 from being inserted past the point where the locking mechanism 10 secures it in place. Stop member 112 is preferably welded to the upright 14 and the flat upper surface of the stop member 112 helps prevent damage to the lower end of the upright 28 which typically is made from a fiberglass material. Stop member 112 is positioned on the sign stand to insure that the sign 16 cannot be positioned below the required or minimum height standard as provided by federal regulations.

Although particular embodiments of the present invention have been illustrated in the accompanying drawings and described in the foregoing detailed description, it is to be understood that the present invention is not to be limited to just the embodiments disclosed, but that they are capable of numerous rearrangements, modifications and substitutions without departing from the scope of the claims hereafter.

It is claimed:

1. A sign retention device for releasably securing a sign to a sign stand, the sign having an elongated vertical cross-brace with at least one aperture therein and the sign stand having a base and an upright member with an upper end, the sign retention device comprising:

a cap member, said cap member having an internal cavity, means for affixing said cap member to the upper end of the upright member, said internal cavity adapted to be positioned over the upper end of the upright member;

said cap member having a channel therein for allowing the vertical cross-brace to pass through in a vertical downward direction substantially parallel to said upright member and be prevented from removal therefrom except in a vertical upward direction, ramp means on said cap member adjacent said channel for directing said vertical cross-brace into said channel, and a biased locking member for mating with an aperture in said vertical cross-brace and securing the cross-brace in place in said cap member.

2. The sign retention device as set forth in claim 1 wherein said upright member has a vertically-oriented elongated channel therein and said channel in said cap member is positioned in axial alignment with the channel in said upright member in order to allow the vertical cross-brace to be positioned in said channel in said upright member after it passes through said channel in said cap member.

3. The sign retention device as set forth in claim 1 wherein said locking member has an enlarged head for manual manipulation thereof.

4. The sign retention device as set forth in claim 1 wherein said cap member is made from a molded plastic material.

5. A system for releasably securing a sign to a sign stand, comprising:

a sign stand having a base and an upright member with an upper end, a sign having a vertically oriented elongated cross-brace with at least one aperture therein, a cap member having a central cavity therein, said cap member positioned over said upper end of said upright member, means for affixing said cap member to said upright member, said cap member having an aperture therein for holding said vertical cross-brace, biased locking means for mating with said aperture in said vertical cross-brace and thereby securing said sign to said sign stand.

6. The system as set forth in claim 5 further comprising ramp means on said cap member for directing said vertical cross-brace into said aperture in said cap member.

7. The system as set forth in claim 5 wherein said upright member has an elongated channel therein and said aperture in said cap member is positioned in axial alignment with said channel.

8. The system as set forth in claim 7 further comprising a stop member in said channel to help position the sign on the sign stand.

9. The system as set forth in claim 5 wherein said locking member has an enlarged head for manual manipulation thereof.

10. The system as set forth in claim 5 wherein said cap member is made from a molded plastic material.

11. The system as set forth in claim 5 wherein said locking means comprises a pin member with a ramped surface on its locking end.

12. The system as set forth in claim 5 further comprising a stop member on said vertical upright to help position the sign on the sign stand.

* * * * *